US006772769B2

(12) United States Patent
Sun

(10) Patent No.: US 6,772,769 B2
(45) Date of Patent: Aug. 10, 2004

(54) PREPARATION OF TOBACCO HAVING REDUCED CONTENTS OF NICOTINE AND TAR

(76) Inventor: Lee Kyu Sun, 634-82 Yeoksam-dong, Kangnam-Gu, Seoul (KR)

( * ) Notice: Subject to any disclaimer, the term of this patent is extended or adjusted under 35 U.S.C. 154(b) by 0 days.

(21) Appl. No.: 10/073,174

(22) Filed: Feb. 13, 2002

(65) Prior Publication Data

US 2002/0153018 A1 Oct. 24, 2002

(30) Foreign Application Priority Data

Feb. 14, 2001 (KR) ..... 2001-7385

(51) Int. Cl.[7] ..... A24D 1/00
(52) U.S. Cl. ..... 131/369; 131/359
(58) Field of Search ..... 131/359, 352, 131/369, 347, 364

(56) References Cited

U.S. PATENT DOCUMENTS 3,747,607 A * 7/1973 Kim ..... 131/140 B 5,135,010 A * 8/1992 Fan ..... 131/359

* cited by examiner

*Primary Examiner*—Dionne A. Walls
(74) *Attorney, Agent, or Firm*—Lee & Sterba, P.C.

(57) ABSTRACT

A tobacco preparation process having reduced contents of nicotine and tar, wherein dried *platycodi radix* (broad bellflower), ginseng radix (*Panax ginseng*) and peach kernel (*persicae semen*) into tabacco leaves are crushed and cut into a specified piece. Dried *playhcodi radix* (broad bellflower), ginseng radix (*Panax ginseng*) and peach kernel (*presicae semen*) are crushed, Eum-yang-kwak (dried leaves of epimedii herbal tea (*Epimedium koreanum*)) are cut into the same size as that of the cutted tobacco leaves and mixture of *platycodi radix* (a broad bellflower), ginseng radix (*Panax ginseng*) and peach kernel (*persicae semen*), Eum-yang-kwak (dried leaves of epimedii herbal tea (*Epimedium koreanum*)) and tobacco leaves at the same proportion.

17 Claims, 1 Drawing Sheet

PREPARATION OF TOBACCO HAVING REDUCED CONTENTS OF NICOTINE AND TAR

BRIEF SUMMARY OF THE INVENTION

The present invention relates to a method for the preparation of tobacco, specifically to a method for the preparation of tobacco having reduced contents of tar and nicotine by adding *platycodi radix* (broad bellflower), ginseng radix (*Panax ginseng*) and peach kernel (*persicae semen*) or Eum-yang-kwak (dried leaves of epimedii herbal tea (*Epimediom koreanum*)) into tobacco leaves which have been cut into a specified size to reduce the toxicity of tobacco, to remove the nicotine and tar contained in the tobacco and to improve the fragrance of tobacco, by which an improvement of health can be achieved by smoking the tobacco.

*Platycodi radix* (broad bellflower) of 2–3 years old, ginseng radix (*Panax ginseng*) of 1 year old and peach kernel (*persicae semen*) or Eum-yang-kwak (dried leaves of epimedii herbal tea (*Epimedium koreanom*)) are dried under shade and are pulverized into a size of 100–130 meshes and are mixed together in an equal proportion.

The mixture of *platycodi radix* (broad bellflower), ginseng radix (*Panax ginseng*) and peach kernel (*persicae semen*) or Eum-yang-kwak (dried leaves of epimedii herbal tea (*Epimedium koreanum*)) are mixed into tobacco leaves which have been cut into a specific size at the proportion of 0.9% herb mixture and 99.1% tobacco leaves to manufacture cigarette and/or tobacco, thereby improving the fragrance of and removing nicotine and tar contents in tobacco.

The formula can be changed by 60% of the sliced tobacco leaves which contain 0.9% herb mixture to 39.1% Eum-yang-kwak (dried leaves of epimedii herbal tea (*Epimedium koreanum*)) or 59.6% tobacco leaves to 39.5% Eum-yang-kwak.

As mild smoke produced by the tobacco product of the present invention causes no coughing, and it will neither displease the smoker himself nor the people around him. Furthermore, as Eum-yang-kwak helps to prevent the mouth from becoming dry and removes bad odor, it will also help promote the health of the smoker while providing a fresh and pleasant taste.

BRIEF DESCRIPTION OF THE INVENTION

DETAILED DESCRIPTION OF THE INVENTION

Figure 1:
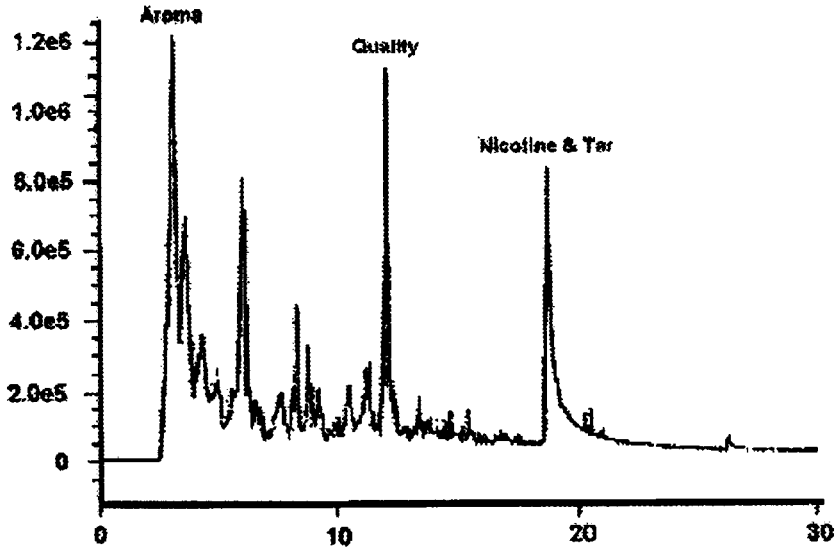
FIG. 1 shows the quantity of aroma, quality, and nicotine and tar emitted by the conventional tobacco.

The present invention relates to a method for the preparation of tobacco, specifically to a method for the preparation of tobacco having reduced tar and nicotine content by adding *platycodi radix* (broad bellflower), ginseng radix (*Panax ginseng*) and peach kernel (*persicae semen*) or Eum-yang-kwak (dried leaves of epimedii herba tea (*Epimedium koreanum*)) into tobacco leaves which have been cut in a specified size to reduce the toxicity of tobacco, to remove the nicotine and tar contained in the tobacco and to improve the fragrance of tobacco, by which an improvement of health can be achieved by smoking the tobacco.

In general, since tobacco smoke has a great and serious toxicity, tobacco smoke is harmful to the smoker as well as to those around the smoker.

In addition, nicotine and tar contained in the tobacco are carried in the tobacco smoke and introduced in the lungs of those exposed to the smoke to cause lung cancer and esophageal cancer. It also creates other problems such as lingering tobacco smell and dryness in the mouth.

As a result, nicotine and tar generated from the tobacco are absorbed into a human body to cause various diseases such as oral cavity carcinoma, pharynx cancer, laryngeal cancer, esophageal cancer, pancreas cancer, kidney cancer, bladder cancer, lung cancer, uterine carcinoma, heart disease, etc.

Under such circumstances, the former United States Bill Clinton has officially declared that tobacco shall be treated as an addictive drug, the World Health Organization Director—General Gro Harlmen Bruntland—has declared a war against tobacco, and European Parliament has determined to ban all tobacco advertising and sponshorship after 2006.

As tobacco has been internationally blamed as a cause of various diseases owing to nicotine and tar and considered as an addictive drug, many tobacco companies in the world have conducted extensive studies to develop methods to remove tar and nicotine from tobacco, but nicotine and tar still remain in tobacco.

As known from oriental medicine, the efficacy and effects on a human body of broad bellflower (platycodon), ginseng (*Panax ginseng*), peach kernel and Eum-yang-kwak are as follows:

The efficacy of broad bellflower (platycodon) lies in "Chung-Pye-Ha-Qi (cleaning lung and lowering (pacifying) "Qi") and "Keo-Dam-Bae-Nong" (the discharge of phlegm and drainage of pus). The efficacy of broad bellflower on a human body is used to assist in the discharge of phlegm, as a cough remedy, to assist in the drainage of pus in the throat, and to alleviate the symptoms of scarlet fever.

Specifically, it is used to alleviate cough symptom resulting from the common cold, upper air-passageway infection, acute bronchitis, pneumonia, etc., or when sputa have a fishy smell owing to acute tonsillitis, acute sore throat, lung abscess, etc. is present.

In case of scarlet fever, an internal use of 10% extract of *platycodi radix* (the root of broad bellflower) is effective in reducing pyrexia (fever) and throat pain. Keeping an olive in the mouth acts as an anti-inflammation agent for the throat.

Meanwhile, broad bellflower (platycodon) activates the five viscera (heart, liver, spleen, lungs and kidneys) and the six entrails (gall blader, stomach, small and large intestines, the paunch, the bladder and the bowels) and decomposes and counteracts poisonous materials in a human body.

The efficacy of ginseng radix lies in the properties of Tae-Bo-Won-Qi (replenishing and supplementing the primordial qi), An-Sin-Ik-Ji (tranquilizing the mind to improve the wisdom), Keon-Bi-Ik-Qi (activating the spleen to improve qi), and Saeng-Jin (promoting fluid circulation in the body), etc. It is also administered and used in life-threatening emergencies. Especially, it is used to treat those having a condition of a weak heart pulse due to imperfect function of the heart and poor circulation in the blood vessel system due to various causes.

It is used for Bi-Wi-Qi-Heo (wherein the primordial qi of the viscera and stomach are weak, or infirmity). Especially, it can be used to treat Sang-Bok-Bi-Man (a tightness of the chest accompanied by a shortness of breath) as may be caused by hepatitis, chronic gastritis, peptic ulcer disease (PUD) or other factors, which may be accompanied by a lack of appetite, diarrhea, vomiting, etc. It can also be used to treat anemia together with drugs for nourishing the blood.

Ginseng radix can also be used for asthma and dyspnoca caused by Pye-Sin-Yang-Huh (a weakness of the lungs and kidneys, which is accompanied by symptoms of shivering). Additionally, it is used for polydipsia (thirst) caused by diabetes or dehydration owing to fever. Especially, it is very effective for a mild case of diabetes, that is, it lowers the level of blood sugar and reduces the elimination of urine sugar. For a serious case of diabetes, it mainly alleviates polydipsia (thirst) and general prostration. It may also be used for nervous disorders since it helps to reduce heart flutters, has a calming effect against agitation, and helps to achieve a calm state of mind. Ginseng radix may also be used to treat impotence and premature ejaculation in males. In addition, it has a preventive effect against cancer.

The efficacy of peach kernel lies in Pa-Hyul-Geo-Huh (disentangling and removing the bad blood which has been congested and entangled in the body, i.e., cleansing the blood) and Yoon-Jo-Hwal-Jang (moistening the dried body to activate the intestines, i.e., hydrating the body).

Peach kernels may also be used for treating diseases relating to extravasated blood, e.g., coagulated blood, for example, Hyul-Eo-Kyung-Tong (pain in blood vessel caused by extravasated blood), intestinal pain in the abdominal region, Kyung-Hang-Bul-Chang, dark-red blood, small amount of blood, menstrual irregularity, a disease in which the flat of the tongue is purple, a disease in which extravasated blood lumps around the tongue to form spot(s), Maek-Sap, Chim-Wan (symptom of prostration due to weak qi), etc.

The peach kernel may also be used to treat internal hemorrhage due to Ta-Bak-Yom-Jwa (tissue distortion by a stroke or blow), and accompanying pain, whether old or new and whether internal or external. It may also be used to treat constipation caused by intestinal dryness.

The peach kernel may also be used as an adjuvant for an acute appendicitis and a lung abscess.

Eum-yang-kwak (dried leaves of Epimidii herbal tea (*Epimedium koreanum*)) functions as a vital tonic of yang-qi and eum-qi in cells and organs of the human body. It facilitates the circulation of blood in the five viscera and the six entrails and promotes vitality and energy. It exhibits an immune activity against cancer cells and tissues, and also exhibits a vital activity against diabetes and constipation when it is applied for a long time.

It can be understood that broad bellflower radix, ginseng radix and peach kernel, and Eum-yang-kwak (dried leaves of *Epimedium kareancrm*), all of which have been employed in the oriental medicine, have beneficial effects and properties for a human body.

THE EMBODIMENT AND OPERATION OF THE INVENTION

MANUFACTURING PROCESS

Manufacturing Process I

Process I

Platycodi radix (broad bellflower) of 2–3 years old, ginseng radix (*Panax ginseng*) of 1 year old and peach kernel (*persicae semen*) or Eum-yang-kwak (dried leaves of epimedii herbal tea (*Epimediam kareanam*)) are dried under shade conditions. These herb materials are dried to have a water content as follows: *platycodi radix* (broad bellflower) 6–10%, ginseng radix (*Panax ginseng*) 10–14% and peach kernel (*persicae semen*) (harvested in June–August) 6–10%, respectively.

Process II

The dried *platycodi radix* (broad bellflower), ginseng radix (*Panax ginseng*) and peach kernel (*persicae semen*) are pulverized into a size between 100–130 mesh, which size cannot infiltrate through a cigarette filter. A small amount of glycerin may be applied.

Process III

The powders of dried *platycodi radix* (a broad bellflower), ginseng radix (*Panax ginseng*) and peach kernel (*persicae semen*) obtained through the Process 2 are mixed with cigarette leaves from which cigarettes will be made.

Manufacturing Process 2

Process I

*Platycodi radix* (broad bellflower) of 2–3 years old, ginseng radix (*Panax ginseng*) of 1 year old and peach kernel (*persicae semen*) and Eum-yang-kwak (dried leaves of epimedii herbal tea (*Epimedium koreanum*)) are dried under shade. These herb materials are dried to have a water content as follows: *platycodi radix* (broad bellflower) 6–10%, ginseng radix (*Panax ginseng*) 10–14%, peach kernel (*persicae semen*) and Eum-yang-kwak (dried leaves of epimedii herbal tea (*Epimedium koreanum*)) 3–7%, respectively.

Process II

*Platycodi radix* (broad bellflower), ginseng radix (*Panax ginseng*) and peach kernel (*persicae semen*) are pulverized to a size between 100–130 mesh, which size does not infiltrate through a cigarette filter. A small amount of glycelin may be applied on the powder.

Process III

Eum-yang-kwak (dried leaves of epimedii herbal tea (*Epimedium koreanum*)) obtained through Process I is cut to the same size the tobacco leaves were cut.

Process IV

The powder of *platycodi radix* (broad bellflower), ginseng radix (*Panax ginseng*) and peach kernel (*persicae semen*) obtained through Process II and Eum-yang-kwak (dried leaves of epimedii herbal tea (*Epimedium koreanum*)) obtained through Process III are mixed with tobacco leaves from which cigarettes will be made.

Manufacturing Process 4

Onto the tobacco leaves and Eum-yang-kwak (dried leaves of epimedii herbal tea (*Epimedium koreanum*)) that were cut at a specific size before the mixture is processed into cigarette machine,the powdered *platycodi radix* (a broad bellflower), ginseng radix (*Penax ginseng*) and peach kernel (*persicae semen*) are sprayed evenly at a rate of 0.3% by weight of the tobacco leaves and Eum-yang-kwak herbal tea.

Example 1

Process I

*Platycodi radix* (broad bellflower) of 2–3 years old, ginseng radix (*Panax ginseng*) of 1 year old and peach kernel (*persicae semen*) harvested in June–August are dried under shade to obtain 300 g of *Platycodi radix* (a broad bellflower), inseng radix (*Panax ginseng*) and peach kernel (*persicae semen*), respectively.

The above herb materials are dried to have to have a water content as follows: *platycodi radix* (broad bellflower) 8.45%, ginseng radix (*Panax ginseng*) 12.6% and peach kernel (*persicae semen*) 7.75%, respectively.

Process II

*Platycodi radix* (broad bellflower), ginseng radix (*Panax ginseng*) and peach kernel (*persicae semen*) obtained through Process I are pulverized to a size between 100–300 mesh, which size does not infiltrate through a cigarette filter. A small amount of glycelin may be applied on the powder.

Process Ill

Each 300 grams of *platycodi radix* (broad bellflower), ginseng radix (*Panax ginseng*) and peach kernel (*persicae semen*) obtained through Process II are mixed to 99–100 grams of tobacco leaves to produce cigarettes.

EXAMPLE 2

The powdered *platycodi radix* (broad bellflower), ginseng radix (*Panax ginseng*) and peach kernel (*persicae semen*) and tobacco leaves are mixred in proportions of 3:3:3:991, and prior to processing the tobacco leaves for manufacturing cigarettes the powder *platycodi radix* (broad bellflower), ginseng radix (*Panax ginseng*) and peach kernel (*persicae semen*) are applied evenly to the tobacco leaves.

EXAMPLE 3

0.3% of powdered *platycodi radix* (broad bellflower), ginseng radix (*Panax ginseng*) and peach kernel (*persicae semen*), respectively, are mixed with 99.1% of tobacco leaves before processing for the manufacture of cigarettes.

EXAMPLE 4

Process I

*Platycodi radix* (broad bellflower) of 2–3 years old, ginseng radix (*Panax ginseng*) of 1 year old, peach kernel (*persicae semen*) harvested in June–August and Eum-yang-kwak (dried leaves of epimedii herbal tea (*Epimedium koreanum*)) are dried under shade for a predetermined period.

Process 2

A 300 g mixture in equal parts of *platycodi radix* (broad bellflower), ginseng radix (*Panax ginseng*) and peach kernel (*persicae semen*), is pulverized to the size between 100–300 mesh, which size does not infiltrate through a cigarette filter. A small amount of glycelin may be applied.

Process 3

Eum-yang-kwak (dried leaves of epimedii herbal tea (*Epimedium koreanum*)) is cut to the same size of the sliced tobacco leaves to obtain 391 g of cut eum-yang-kwak.

Process 4

Each 3 g of powdered *platycodi radix* (broad bellflower), ginseng radix (*Panax ginseng*) and peach kernel (*persicae semen*), respectively, obtained through Process II and 391 g of Eum-yang-kwak (dried leaves of epimedii herbal tea (*Epimedium koreanum*)) cut to a specific size are mixed to 600 g of sliced tobacco leaves to manufacture cigarettes.

EXAMPLE 5

Sliced tobacco leaves and sliced herb materials, Eum-yang-kwak (dried leaves of epimedii herbal tea (*Epimedium koreanum*)), *platycodi radix* (a broad bellflower), ginseng radix (*Panax ginseng*), and peach kernel (*persicae semen*), are mixed at the ratio of 600:391:3:3:3, respectively, to produce cigarettes.

EXAMPLE 6

Sliced tobacco leaves and sliced herb materials, Eum-yang-kwak (dried leaves of epimedii herbal tea (*Epimedium koreanum*)), *platycodi radix* (a broad bellflower), ginseng radix (*Panax ginseng*), and peach kernel (*persicae semen*), are mixed at the ratio of 596:395:3:3:3, respectively, to produce cigarettes.

EXAMPLE 7

*Platycodi radix* (broad bellflower), ginseng radix (*Panax ginseng*), and peach kernel (*persicae semen*) are mixed at ±0.1%, and sliced tobacco leaves and Eum-yang-kwak (dried leaves of epimedii herbal tea (*Epimedium koreanum*)) are mixed at a ratio of 6:4, to produce cigarettes.

The following comparison table shows the differences between the existing cigarettes and those that contain Eum-yang-kwak (dried leaves of epimedii herbal tea (*Epimedium koreanum*)), *platycodi radix* (a broad bellflower), ginseng radix (*Panax ginseng*), and peach kernel (*persicae semen*):

| Conventional Cigarette | Cigarette containing Eum-yang-kwak (dried leaves of epimedii herbal tea (*Epimedium koreanum*)), platycodi radix (broad bellflower), ginseng radix (Panax ginseng), and peach kernel (persicae semen): |
|---|---|
| 1. Tastes burning dried grass | 1. Mild smoke |
| 2. Strong smoke | 2. Mild taste |
| 3. Taste gradually becomes bitter | 3. Nicotine and tar substantially |
| 4. Rough Tongue eliminated | 4. Long time smoking causes no dizziness |
| 5. Aggravated fatigue | 5. No fatigue |
| 6. Vomiting from long smoking | 6. Consistent mild taste |
| 7. Dizziness | 7. Pleasant flavor hides cigarette odor |
| 8. Decrease of appetite | 8. No offensive smoke in a small confined space |
| 9. Dryness | 9. No dryness in mouth |
| 10. Unpleasant mouth odor caused by nicotine and tar | 10. No foul breath by nicotine and tar |
| 11. Rough tongue | 11. No dryness |

As will be appreciated the cigarettes produced according to the process of this invention is mild and helps to prevent formation of hard, obstructive phlegm in the throat, and by virtue of having a reduced content of nicotine and tar, these hazardous substances are significantly reduced and protects people around the smoker from indirect adverse effects.

Figure 2:
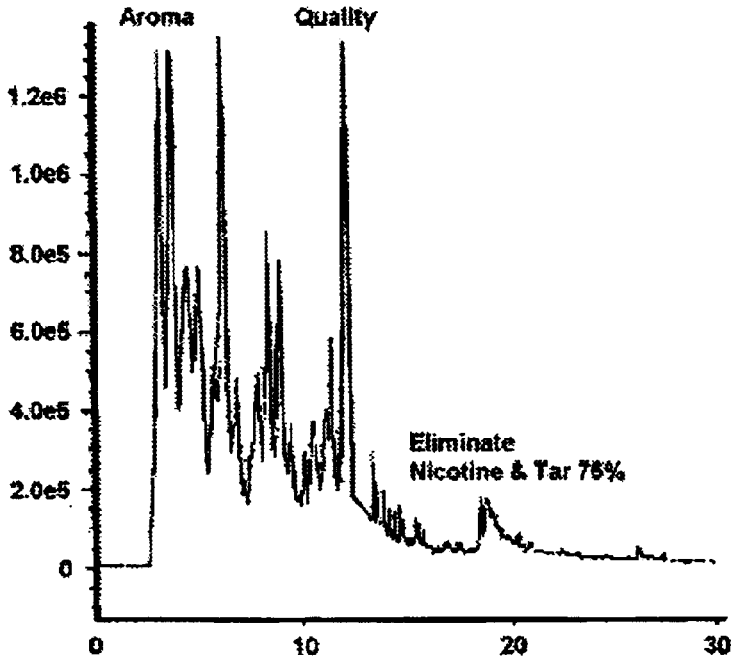
FIG. 2 shows the quantity of aroma, quality, and nicotine and tar emitted by tobacco containing *platycodi radix* (broad bellflower), ginseng radix (*Panax ginseng*), and peach kernel (*persicae semen*).

A comparison of both FIGS. 1 and 2 shows that the tobacco of the present invention emits a lot more aroma than that of the conventional tobacco.

In regard to the quality, both the conventional tobacco and the tobacco of the present invention are similar as shown in FIGS. 1 and 2.

In regard to the contents of nicotine and tar, as exhibited in FIGS. 1 and 2, contrary to the conventional tobacco having a high content, the tobacco of the present invention exhibits a 75% reduction of these harmful substances.

In comparison with the conventional tobacco, the tobacco of the present invention maintains the same quality, much better aroma, and 75% of nicotine and tar removed.

Reduced contents of nicotine and tar will reduce the risk posed by these hazardous substances and will contribute in the reduction of air pollution.

Additional advantage from applying Eum-yang-kwak (dried leaves of epimedii herbal tea (*Epimedium koreanum*)), *platycodi radix* (broad bellflower), ginseng radix (*Panax ginseng*), and peach kernel (*persicae semen*) in the production of tobacco products will boost rural economy as farmers will be engaged in mass production of these herb materials.

What is claimed is:

1. A process for preparing a tobacco preparation having reduced contents of nicotine and tar, wherein dried *platycodi radix* (broad bellflower), ginseng radix (*Panax ginseng*) and peach kernel (*persicae semen*) are crushed and applied to tobacco leaves.

2. The process according to claim 1, wherein dried *platycodi radix* (broad bellflower), ginseng radix (*Panax ginseng*) and peach kernel (*persicae semen*) are mixed with cut eum-yang-kwak (dried leaves of epimedii herbal tea (*Epimedium koreanum*)) in equal proportions before being applied to the tabacco leaves.

3. The process according to claim 1, wherein the proportion of dried *platycodi radix* (broad bellflower), ginseng radix (*Panax ginseng*) and peach kernel (*persicae semen*) to tobacco leaves is at a ratio of 3:3:3:991.

4. The process according to claim 1, wherein the *platycodi radix* (broad bellflower) harvested are 2~3 years old.

5. The process according to claim 1, wherein the ginseng radix (*Panax ginseng*) harvested is 1 year old.

6. The process according to claim 1, wherein the peach kernel (*persicae semen*) is harvested in June~August.

7. The process according to claim 1, wherein the mixture of dried *platycodi radix* (broad bellflower), ginseng radix (*Panax ginseng*) and peach kernel (*persicae semen*) into tobacco leaves are at a ratio of 3:3:3~5:989~991.

8. The process according to claim 1, wherein glycerin is sprayed on the crushed dried *platycodi radix* (broad bellflower), ginseng radix (*Panax ginseng*) and peach kernel (*persicae semen*).

9. The process according to claim 1, wherein dried *platycodi radix* (broad bellflower), ginseng radix (*Panax ginseng*) and peach kernel (*persicae semen*) are crushed to a size, which size does not infiltrate through a cigarette filter.

10. The process according to claim 1, wherein dried *platycodi radix* (broad bellflower), ginseng radix (*Panax ginseng*) and peach kernel (*persicae semen*) are crushed to a size between 100 to 130 mesh.

11. The process according to claim 1, wherein *platycodi radix* (broad bellflower), ginseng radix (*Panax ginseng*) and peach kernel (*persicae semen*) are dried in the shade.

12. The process according to claim 2, wherein the amount of *platycodi radix* (broad bellflower), ginseng radix (*Panax ginseng*) and peach kernel (*persicae semen*) added is 0.9%, and tobacco leaves and eum-yang-kwak (dried leaves of epimedii herbal tea (*Epimedium koreanum*)) which were cut into a specified size are mixed at the a ratio of 6:4.

13. The process according to claim 11, wherein *platycodi radix* (broad bellflower), ginseng radix (*Panax ginseng*) and peach kernel (*persicae semen*) and eum-yang-kwak (dried leaves of epimedii herbal tea (*Epimedium koreanum*)) are dried to have a water content as follows: *playcodi radix* (broad bellflower) 6~10%, ginseng radix (*Panax ginseng*) 10–14%, peach kernel (*persicae semen*) 6~10% and eum-yang-kwak (dried leaves of epimedii herbal tea (*Epimedium koreanum*)) 3~7%.

14. The process according to claim 2, wherein dried *platycodi radix* (broad bellflower), ginseng radix (*Panax ginseng*) and peach kernel (*persicae semen*) are crushed to a size which size does not infiltrate through a cigarette filter.

15. The process according to claim 2, wherein dried *platycodi radix* (broad bellflower), ginseng radix (*Panax ginseng*) and peach kernel (*persicae semen*) are crushed to a size between 100 to 130 mesh.

16. The process according to claim 2, wherein *platycodi radix* (broad bellflower), ginseng radix (*Panax ginseng*) and peach kernel (*persicae semen*) and eum-yang-kwak (dried leaves of epimedii herbal tea (*Epimedium koreanum*)) are dried in the shade.

17. The process according to claim 16, wherein *platycodi radix* (broad bellflower), ginseng radix (*Panax ginseng*) and peach kernel (*persicae semen*) and eum-yang-kwak (dried leaves of epimedii herbal tea (*Epimedium koreanum*)) are dried to have a water content as follows: *playcodi radix* (broad bellflower) 6–10%, ginseng radix (*Panax ginseng*) 10–14%, peach kernel (*persicae semen*) 6–10% and eum-yang-kwak (dried leaves of epimedii herbal tea (*Epimedium koreanum*)) 3–7%.

* * * * *